United States Patent [19]

Babcock et al.

[11] Patent Number: 4,668,129

[45] Date of Patent: May 26, 1987

[54] RETAINING WALL SYSTEM USING SOIL ARCHING

[75] Inventors: John W. Babcock, Huntsville, Utah; Ronald K. Wormus; John D. Nelson, both of Fort Collins, Colo.

[73] Assignee: Stresswall International Incorporated, Fort Collins, Colo.

[21] Appl. No.: 773,328

[22] Filed: Sep. 6, 1985

[51] Int. Cl.[4] ..... E02D 29/02

[52] U.S. Cl. ..... 405/284; 405/286

[58] Field of Search ..... 405/284, 285, 286, 287, 405/258, 262

[56] References Cited

U.S. PATENT DOCUMENTS

| | | | |
|---|---|---|---|
| 1,356,319 | 10/1920 | Smulski | 405/286 |
| 2,879,647 | 3/1959 | Hayden | 405/286 X |
| 4,050,254 | 9/1977 | Meheen et al. | 405/286 X |

FOREIGN PATENT DOCUMENTS

| | | | |
|---|---|---|---|
| 321875 | 9/1902 | France | 405/284 |
| 1402 | of 1908 | United Kingdom | 405/284 |

*Primary Examiner*—David H. Corbin

*Attorney, Agent, or Firm*—William W. Cochran, II

[57] ABSTRACT

A retaining wall system which uses rigid tieback elements having portions, column portions and web portions and wall panels disposed between the tieback elements. The tieback elements are designed to produce arching in the soil to reduce bearing stresses on the soil below base portions of the tieback elements by providing web portions sufficiently large to produce a complete ditch condition in the soil upon movement of the rigid tieback elements. This provides an economical retaining wall system in which multiple tiered walls can be spaced by an amount sufficient to produce a complete ditch condition. The wall can be implemented as a vertical wall or as a battered wall.

16 Claims, 19 Drawing Figures

RETAINING WALL SYSTEM USING SOIL ARCHING

BACKGROUND OF THE INVENTION

1. Field of Invention

The present invention pertains generally to soil engineering and more particularly to retaining walls.

2. Discussion of the Background of the Invention

Various retaining wall systems have been developed for retaining soil on an embankment. Following patents are examples of retaining wall systems which have been developed over a number of years:

| U.S. Pat. No. | Inventor | Date |
|---|---|---|
| British Patent No. 1402 | Walter E. Adams | Apr. 23, 1908 |
| 1,778,574 | J. H. Thornley | Oct. 14, 1930 |
| 1,909,299 | H. B. Mette | May 16, 1933 |
| 4,050,254 | Meheen et al. | Sept. 27, 1977 |
| 4,260,296 | Hilfiker | April 7, 1981 |
| 4,384,810 | Newmann | May 24, 1983 |

In conventional retaining wall design, one of the major design criteria is the pressure exerted on the foundation at the toe of the wall system. This becomes particularly limiting in tall vertical walls with sloping backfill. Conventionally designed cantilevered walls reduce the toe pressure by providing an arm perpendicular to and behind the wall face upon which the vertical load of the backfill acts, creating a moment opposite in direction to the moment due to the horizontal force of the backfill material on the wall face. This "moment" is increased for design purposes by increasing the area of the cantilever arm subject to the vertical loads by increasing the size or length of the moment arm until a suitable toe pressure is reached and a suitable factor of safety against overturning is reached, e.g., a factor of safety greater than 1.5. In other words, the resultant vertical force on the tieback lever arm which extends into the soil and the moment arm of this resultant vertical force about the toe of the wall acts is increased by increasing the length and horizontal surface area of the cantilevered arm until it is equal to 15 times the moment produced by the horizontal resultant force produced by the backfill on the inside wall face of the retaining wall. By reducing this "overturning moment," bearing pressures on the toe of the retaining wall system are decreased.

Many different schemes for increasing the opposing moment force, i.e., the vertical force on the lever arm, have been employed and are well known in the art. For example, British Pat. No. 1402 issued in 1908 to Walter E. Adams discloses a retaining wall structure having frames A which support wall panels B. The Adams device resists overturning by leverage due to the vertical resolved weight of the frame A. Adams discloses on page 1, line 20–25, that the greater the vertical force, the longer the leverage and the greater the resistance of the wall to the overturning moment.

U.S. Pat. No. 4,050,254 issued Sept. 27, 1977 to Meheen et al. discloses a similar system which achieves a safety factor for overturning by extending the lever arm into the soil backfill. This transmits the horizontal pressure on the retaining wall back into the overburden. The reinforcing web of the Meheen et al. patent forms a part of the unitary structure of the tieback element.

The disadvantages and limitations of static leverage walls such as disclosed in Adams and Meheen is that the base portions of the tieback elements must be considerably longer than the column portions which engage the wall panels in order to produce a factor of safety which is sufficient to overcome the overturning moment, i.e., the resultant horizontal force on the panels which is resolved into the column portion (vertical portion) of the tieback element. For example, Meheen et al. teaches the use of column beams 10 feet high and leg beams 28 feet long. Consequently a considerable cut must be made into the soil behind the retaining wall in comparison to the height of the soil retained for conventional static leverage retaining wall systems in order to meet suitable factors of safety. This design constraint effectively limits the height of a wall to single tiers 10 to 12 feet high. Higher walls can only be created by setting back subsequent tiers, as illustrated in the Meheen et al. patent.

SUMMARY OF THE INVENTION

The present invention overcomes the disadvantages and limitations of the prior art by providing a retaining wall system wherein tieback elements are used which generate shears in the soil mass upon movement. The tieback elements have web portions which are sufficiently large to help create a complete ditch condition to occur upon minimal movement of the tieback element, i.e., shear stresses are developed from the tieback unit to the ground surface when the tieback element moves in the soil. This causes active arching in the soil which reduces the bearing stresses below the tieback unit.

Consequently, the present invention may comprise a method of retaining soil using a plurality of rigid tieback elements having base portions, column portions and web portions which couple the base portions and column portions comprising the steps of producing arching in the soil to reduce bearing stresses on the soil below the base portions by providing web portions sufficiently large to produce a complete ditch condition in the soil upon minimal movement of the rigid tieback element and integrally engage a sufficient amount of soil around said tieback base element to produce shears between said soil surrounding said tieback base element and other soil which are sufficiently large to support the tieback element at load values which exceed the bearing capacity of the soil in response to forces transferred from the wall panels into the tieback elements.

The advantages of the present invention are that considerably shorter tieback elements can be used because of the soil arching produced upon movement of the tieback elements. Additionally, vertical walls can be produced by providing a sufficient amount of space between vertical tiers to allow movement of the tieback elements by an amount sufficient to produce soil arching. Soil arching reduces bearing stresses by an amount sufficient to allow stacking of the retaining wall in a vertical or substantially vertical orientation.

BRIEF DESCRIPTION OF THE DRAWINGS

An illustrative and presently preferred embodiment of the invention is shown in the accompanying drawings, wherein.

DETAILED DESCRIPTION OF THE PREFERRED EMBODIMENT OF THE INVENTION

Figure 1:
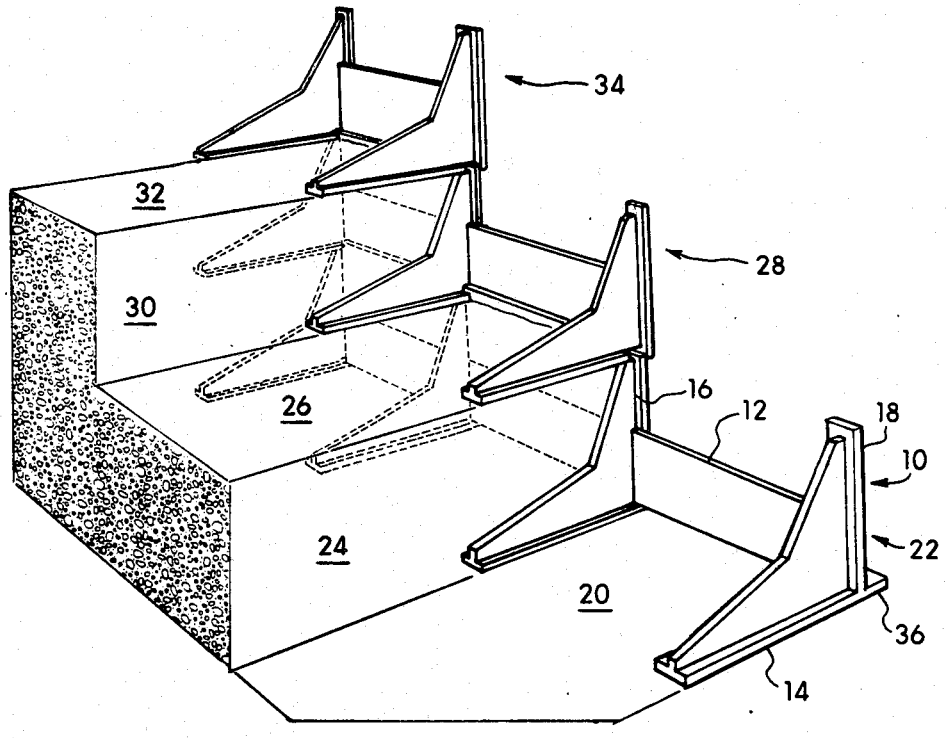
FIG. 1 is a schematic rear isometric view of a multi-tiered retaining wall comprising one embodiment of the present invention.

FIG. 1 is a schematic isometric diagram of a rear portion of a multitiered retaining wall comprising one embodiment of the present invention which illustrates the manner in which the tiers of the multitier retaining wall are stacked. The retaining wall system consists of a series of precast concrete tieback counterforts which support precast concrete panels 12 that span between the tieback elements 10. The tieback elements 10 are spaced on a substantially horizontal plane with the base portions 14 disposed substantially horizontally. The spacing of the tieback elements 10 for each design can be selected as appropriate. The tieback elements 10 are spaced to engage precast concrete panels 12 along the flange portion 16 of column portions 18. The individual components of the retaining wall system, i.e., the tieback elements 10 and wall panels 12, are not rigidly connected to one another.

The retaining wall system illustrated in FIG. 1 is constructed in tiers beginning with placement of the precast tieback elements 10 on a first tier on a substantially horizontal and compacted surface 20 to form a first tier 22. Backfill 24 is then placed behind the wall panels 12 and compacted around the tieback elements 10 until a substantially flat horizontal surface 26 is attained. A second tier 28 is then formed by placing the concrete tieback elements 10 on a substantially flat and horizontal surface 26. Wall panels 12 of the second tier are then placed behind the concrete tieback elements and backfill 30 is placed behind the wall panels 12 and compacted around the tieback elements 10 of second tier 28 to form a substantially flat horizontal surface 32 on which a third tier 34 is formed. This process can be continued until the desired number of tiers is attained. As illustrated in FIG. 1, the lowest tier or base tier has a footing portion 36 which functions to offset overturning moment forces.

Figure 2:
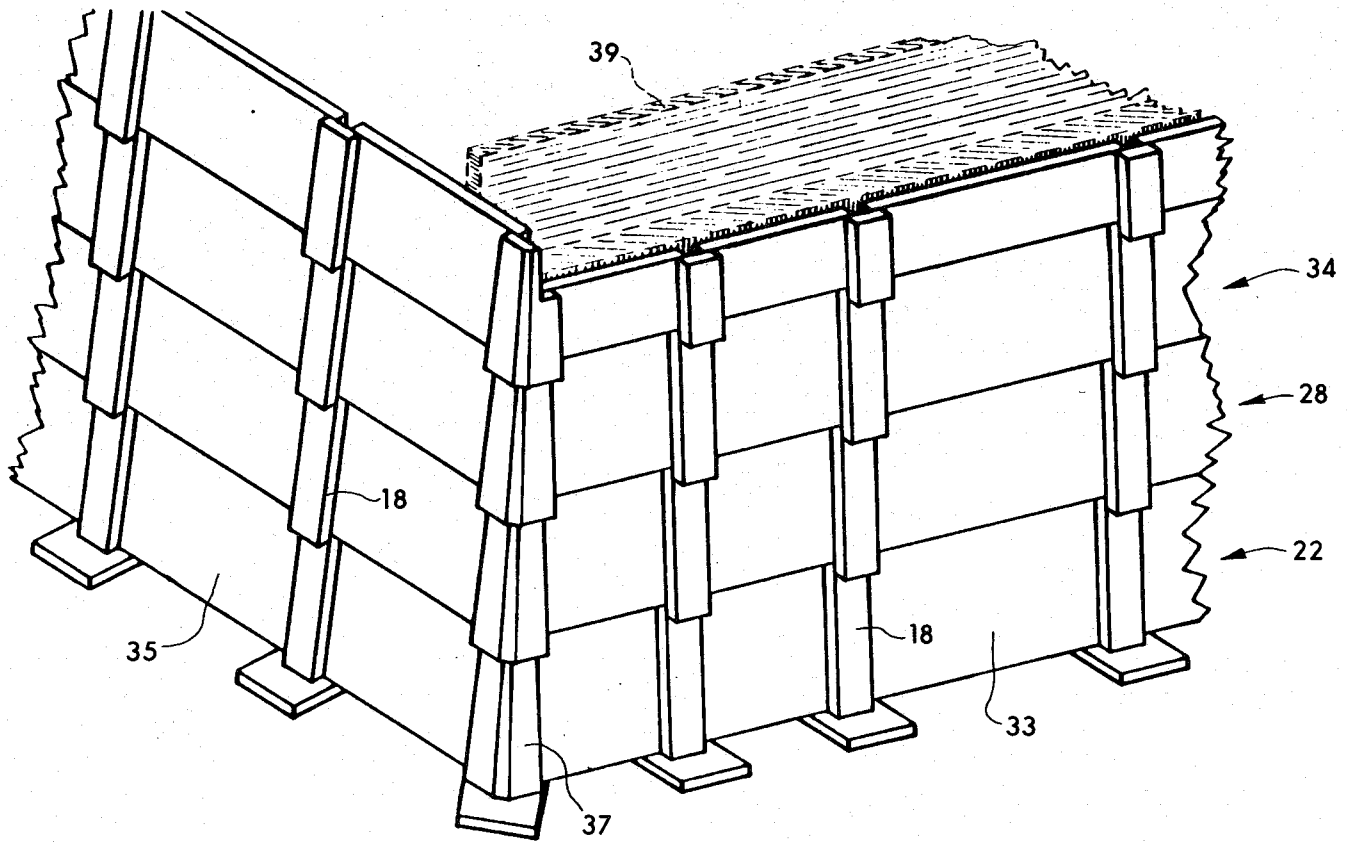
FIG. 2 is a schematic isometric front view of the embodiment of FIG. 1 implemented as a bridge abutment.

FIG. 2 is a front isometric view of the retaining wall system employed as a bridge abutment. As illustrated in FIG. 2, the retaining wall system has a "ship lap" type of configuration because of the overlapping of each subsequently higher tier. The battered configuration of the column portions 18 allows the tieback elements of each of the tiers 22, 28 and 34 to be successively overlapped to provide a substantially vertical retaining wall. As shown in FIG. 2, the abutment wall 33 joins the side wall 35 at a corner which uses specially designed column portions 37 to provide a 90° angle. Of course, column portions having other angular relationships can be used in accordance with the present invention. The bridge abutment 39 is placed behind abutment wall 33 and abutment wall 33 provides a support for soil adjacent the bridge abutment 39.

Figure 3:
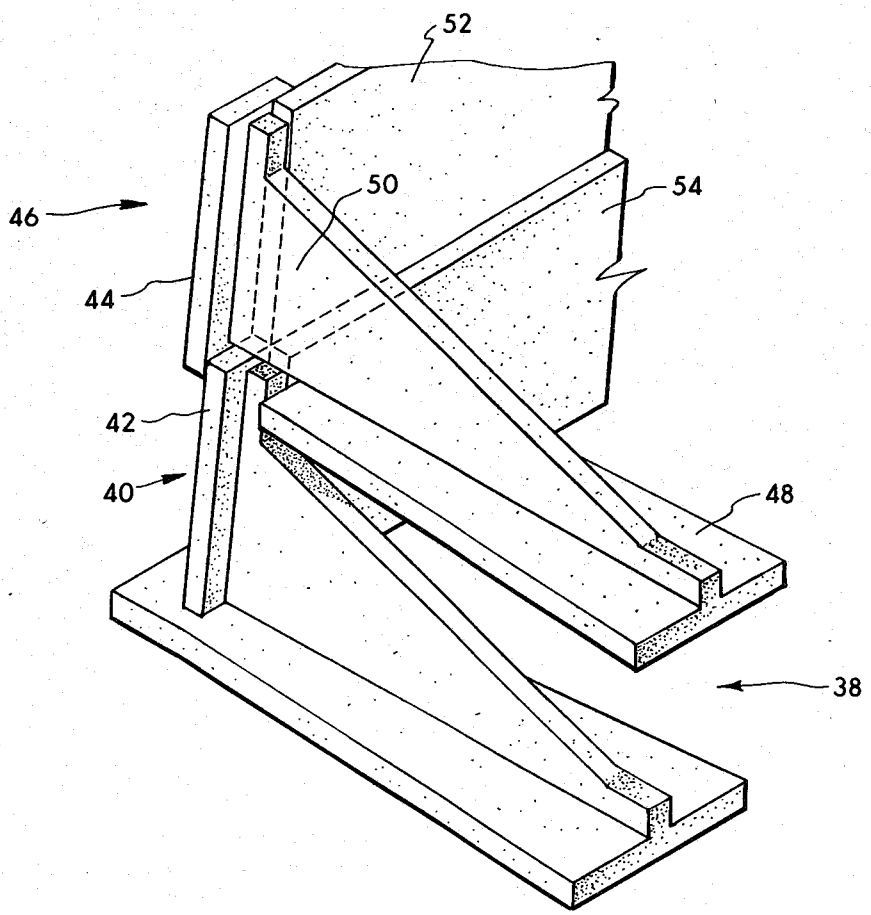
FIG. 3 is a schematic isometric view illustrating the manner in which tieback elements are coupled together in tiers in accordance with one embodiment of the present invention.

FIG. 3 is an isometric view illustrating the manner in which tieback elements of two vertically disposed tiers are joined together. As illustrated in FIG. 3, tieback element 38 of the base tier has a column portion 40 which is battered at a small predetermined angle so that the displacement over its entire height is slightly greater than the thickness of the flange portion 42. Consequently, the front surface of column 40 at its bottom is approximately vertically aligned with the front surface of column 44 at its bottom portion.

A key design feature of the retaining wall system of the present invention is the vertical spacing between adjacent vertical tiers. This vertical spacing is attained by providing a base portion 48 which does not attach directly to column portion 44, but rather, leaves a gap sufficient to allow column portion 40 of a lower tier to be inserted within the interstitial opening between base portion 48 and column portion 44. Additionally, upon assembly of the second tier, base portion 48 is placed on a graded portion of the backfill to provide vertical spacing between the bottom of web 50 and the top of column 40 so that the vertically disposed tiers can move independently. Wall panel 52 rests directly upon the top of column portion 42 and overlaps wall panel 54 such that no vertical gaps are provided on the face of the retaining wall system.

Figure 4:
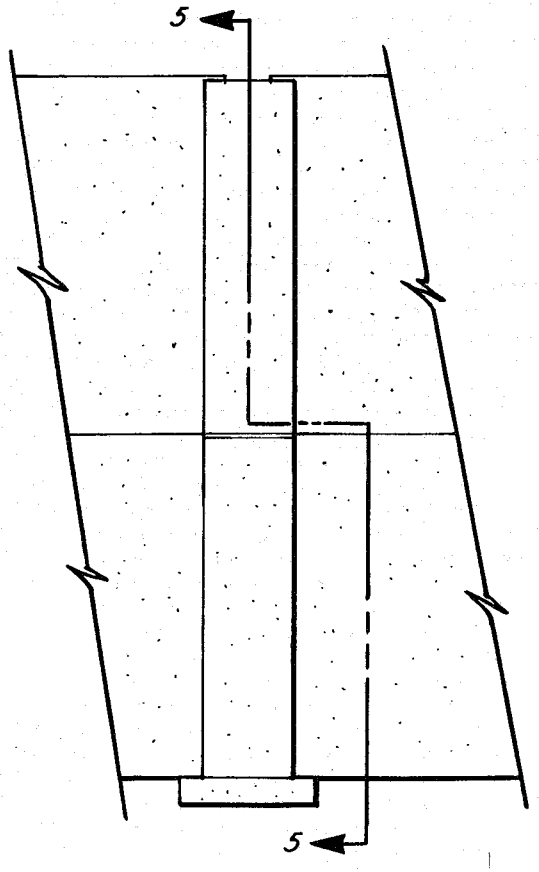
FIG. 4 is a front view of the two tiered wall illustrated in FIG. 3.

FIG. 4 is a front view of a portion of the two tiered retaining wall illustrated in FIG. 3. As shown in FIG. 4, the wall panels and column portions overlap in a "ship lap" design so that no vertical gaps are apparent.

Figure 5:
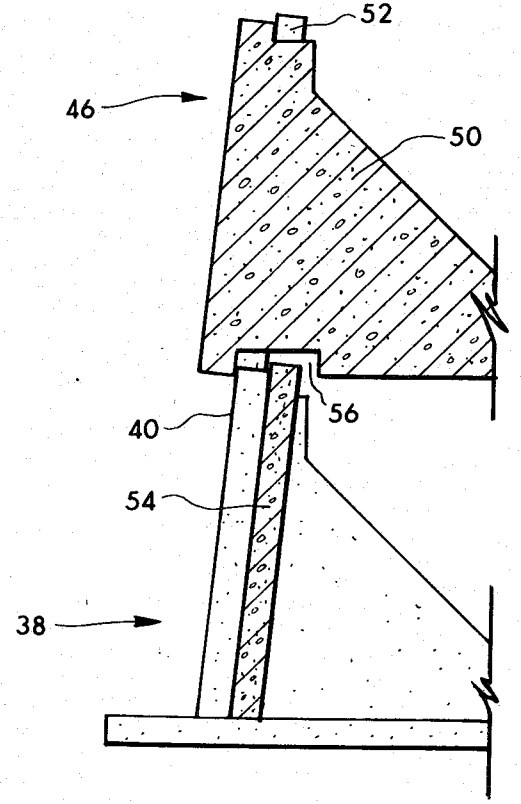
FIG. 5 is a cut-away view of the two-tiered wall illustrated in FIG. 4

FIG. 5 is a cross-sectional view of FIG. 4 illustrating the gap or opening 56 in which the column portion 40 and wall panel 54 are inserted. As illustrated in FIG. 5, a vertical clearance is provided between column portion 40, wall panel 54 and web portion 50. This vertical clearance allows the upper tieback element 46 to independently move in a vertical direction relative to lower tieback unit 38. Vertical displacement of the upper tieback unit 46 can occur from settling of the upper tieback unit in response to vertical stresses on base portion 48 and overturning moment forces on tieback unit 46 transmitted from wall panel 52. FIG. 5 also illustrates the manner in which wall panel 52 rests directly upon, and is supported by, column portion 40 of tieback unit 38. Support of the wall panel 52 in this manner ensures that no vertical gaps are present between vertical tiers as a result of the fact that wall panel 54 extends to a height greater than column portion 40. Additionally, support of wall panel 52 by column portion 40 ensures that wall panel 52 remains in its proper vertical position.

Figure 6:
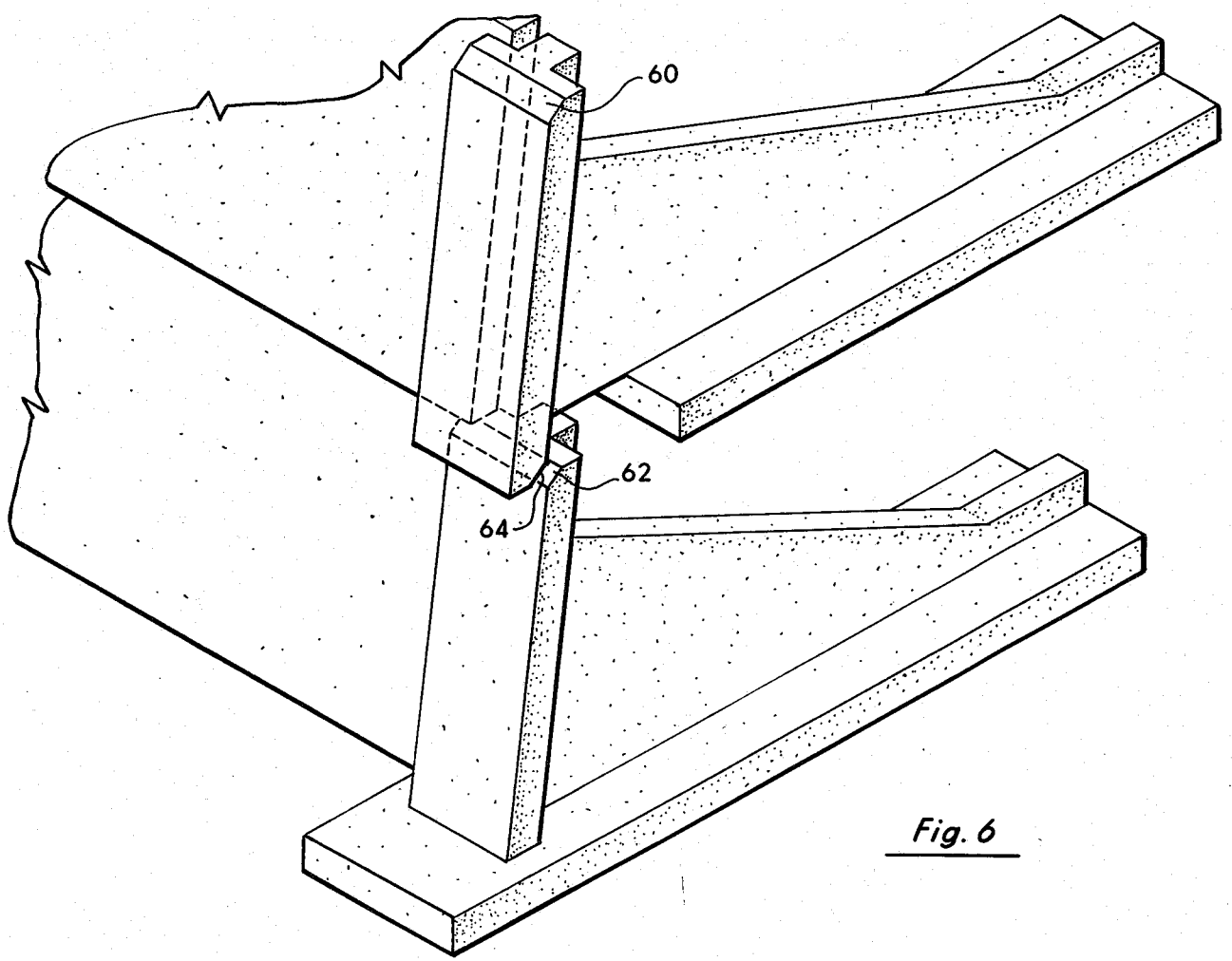
FIG. 6 is a front isometric view of another embodiment of the present invention illustrating the manner in which two tiers are coupled together.
Figure 7:
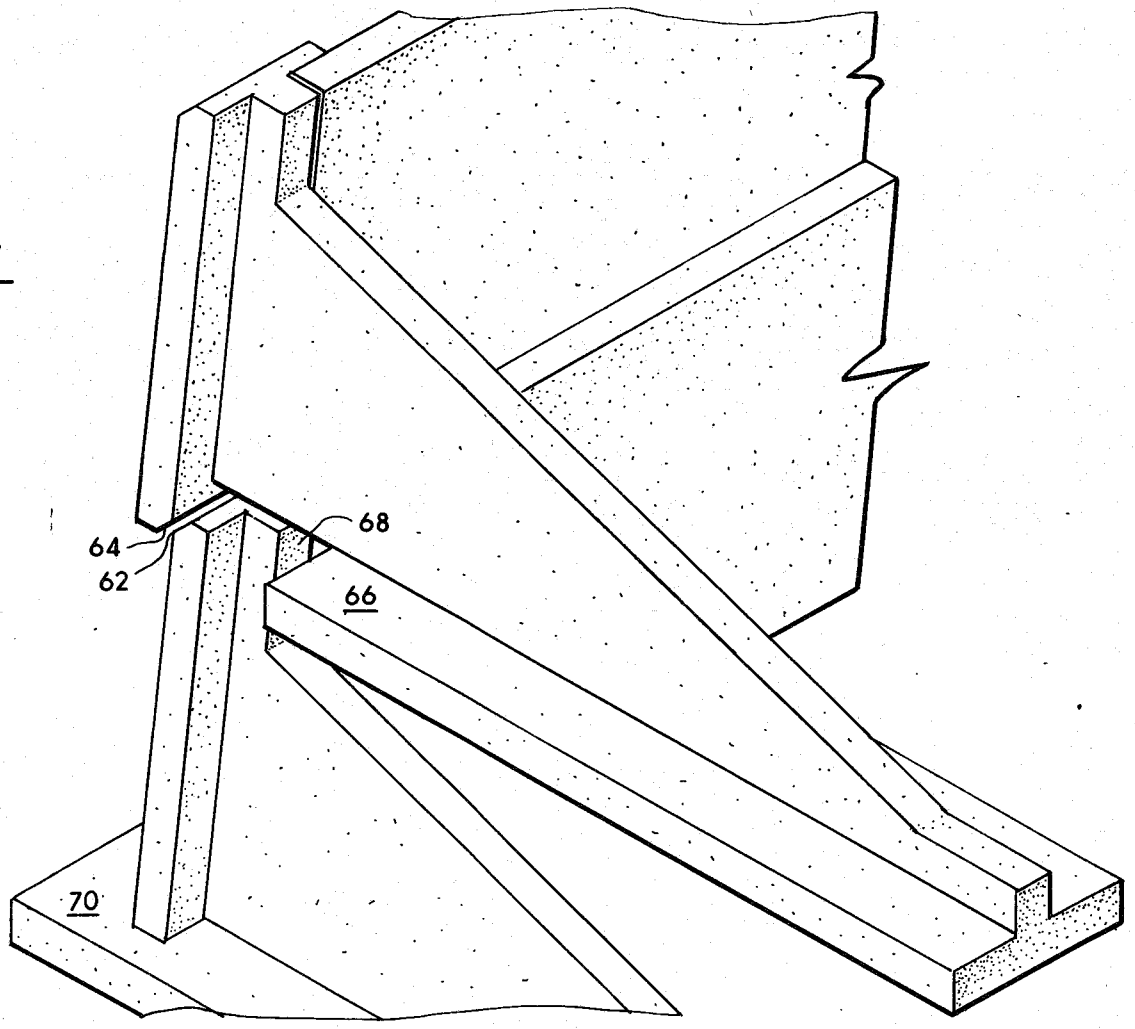
FIG. 7 is a rear isometric view of the two-tiered wall illustrated in FIG. 6.

FIGS. 6 and 7 are schematic isometric views of the front and back, respectively, of a modified version of the embodiment illustrated in FIGS. 1 through 5. As illustrated in FIG. 6, the column portions have beveled surfaces 60, 62, 64 which provide additional clearance between adjacent vertical tiers to ensure that adequate vertical movement can be attained between the adjacent vertical tieback units. The beveled portions 60, 62 still provide sufficient surface area on top of the column portion to support a wall panel.

FIG. 7 is a rear isometric view of the embodiment illustrated in FIG. 6. As shown in FIG. 7, a gap is formed between the beveled surfaces 62, 64 which provide additional vertical clearance. FIG. 7 also illustrates the manner in which base portion 66 is truncated to provide sufficient clearance for column portion 68. Truncated base portions are required for each tieback element for upper tiers to accommodate the column portions of the tieback element of the next lower tier. The base tier, of course, extends beyond the column portion in a forward direction to provide a footer portion 70 which decreases bearing stresses on soil below base portion 70.

Figure 8:
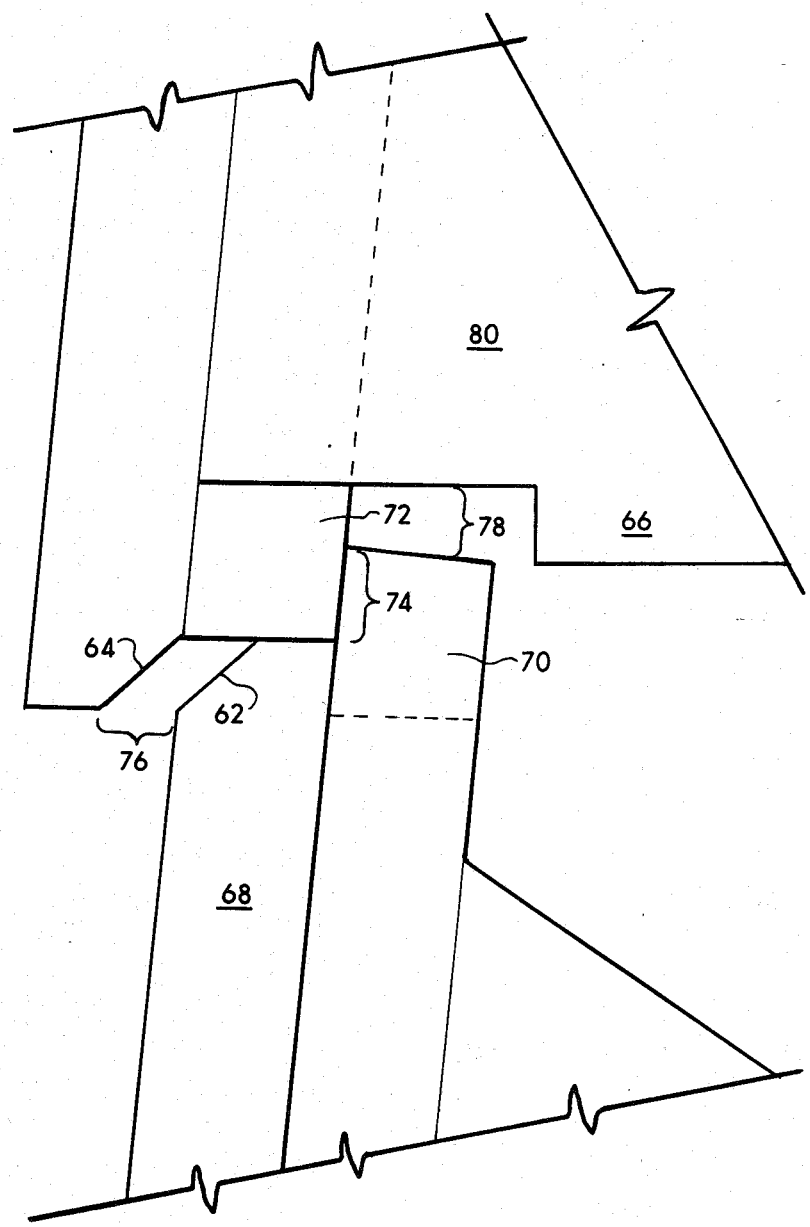
FIG. 8 is a side view illustrating the interconnection between two tiers of the embodiment illustrated in FIGS. 6 and 7.

FIG. 8 is a schematic side view of the embodiment illustrated in FIGS. 6 and 7. FIG. 8 illustrates the manner in which wall panels 70, 72 engage column portions 68 and each other. An overlap portion 74 between the wall panels ensures that no vertical gaps are provided on the wall face. FIG. 8 also illustrates the gap 76 provided between beveled surfaces 62, 64 and the gap 78 provided between adjacent tiers. The gaps 76, 78 are sufficiently large to allow sufficient movement between vertical tiers to create arching in the soil and thereby reduce bearing stresses on soil below the base portions. Web portion 80, which is attached to base portion 66, is sufficiently large to produce a complete ditch condition in the soil upon movement of the tieback elements. Generation of the complete ditch condition ensures that soil arching will reduce bearing stresses below base portion 66. This is also true for the base tier and upper tiers of the retaining wall.

As indicated above, the tieback elements serve to reinforce the backfill behind the wall panels. Arching occurs in the backfill around the tieback elements. The design of the individual tieback elements allows active soil conditions to develop in backfill which causes upward vertical shearing stresses to be created in the soil around the tieback units so as to reduce the forces exerted on the footing or front of the base of the tieback element.

Analysis

Design analysis of the retaining wall system of the present invention depends, of course, upon the geotechnical conditions at each particular wall site. The analysis must consider both stability of individual tieback counterforts which support the wall panels and the overall stability of the tiered system acting as a unit. The stability of the individual tiebacks usually represents the critical design factor. When this has been assured by proper design, overall stability can be demonstrated. A typical analysis of the retaining wall system of the present invention proceeds in accordance with the following steps:

1. Computation of the forces acting on the wall panels and tieback counterforts of each tier using active earth pressure theory;
2. Determination of vertical stresses on tiebacks and bearing stresses below the tieback footings using Marston's Theory;
3. Determination of the pullout resistance of the tiebacks;
4. A check of the factors of safety against overturning and sliding for the wall system as a unit;
5. A check of the factor of safety for slope stability of the wall system as a unit.

In the design analysis, the effect of soil arching occurring above individual tieback counterforts must be taken into account. This arching reduces bearing stresses at the toe (front) of the footing (base) of each tieback element and enhances the uplift resistance (resistance to vertical movement) at the heel (back) of the base of the tieback element.

The phenomenon of arching is disclosed in Terzaghi (1943) *Theoretical Soil Mechanics*, John Wiley & Sons, New York, to describe the reduction in stresses over a yielding trap door. This citation is specifically incorporated herein by reference for all that it discloses. Marston developed the theory of arching in the early part of the twentieth century to predict loads on buried pipes and conduits. Marston's Theory is presented in Spangler and Handy (1982) *Soil Engineering*, 4th Edition, Harper & Row Publishers, New York, in a form to permit application to the design of buried conduits. This citation is specifically incorporated herein by reference for all that it discloses.

The present invention has uniquely utilized these theories for analyzing stresses produced on multiple tier retaining walls to compute vertical forces acting on each tier, using active earth pressure theory, and computing vertical bearing stresses on soil below base portions of tieback units independently for each tier, using Marston's Theory of loads on underground conduits. However, in order to account for the differences in geometry between the tieback units and a buried conduit, certain assumptions must be made in the analysis of the retaining wall system of the present invention.

Figure 9:
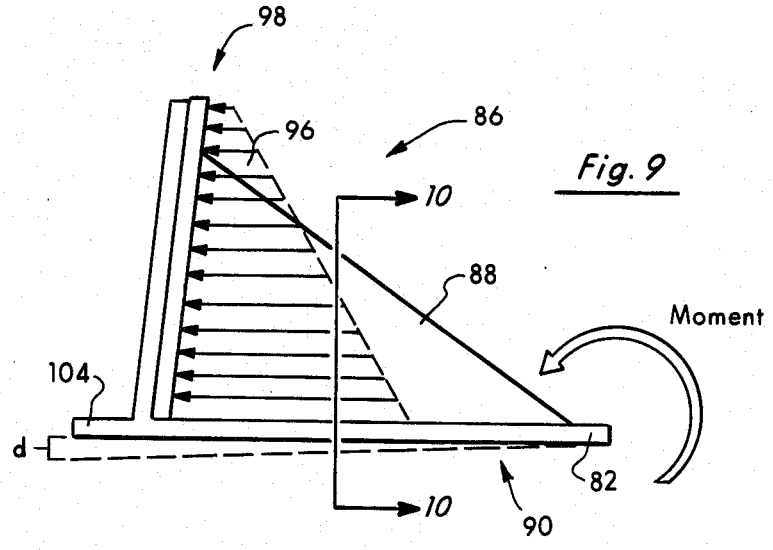
FIG. 9 is a schematic side view of a single tieback element illustrating the forces acting on the tieback element.
Figure 10:
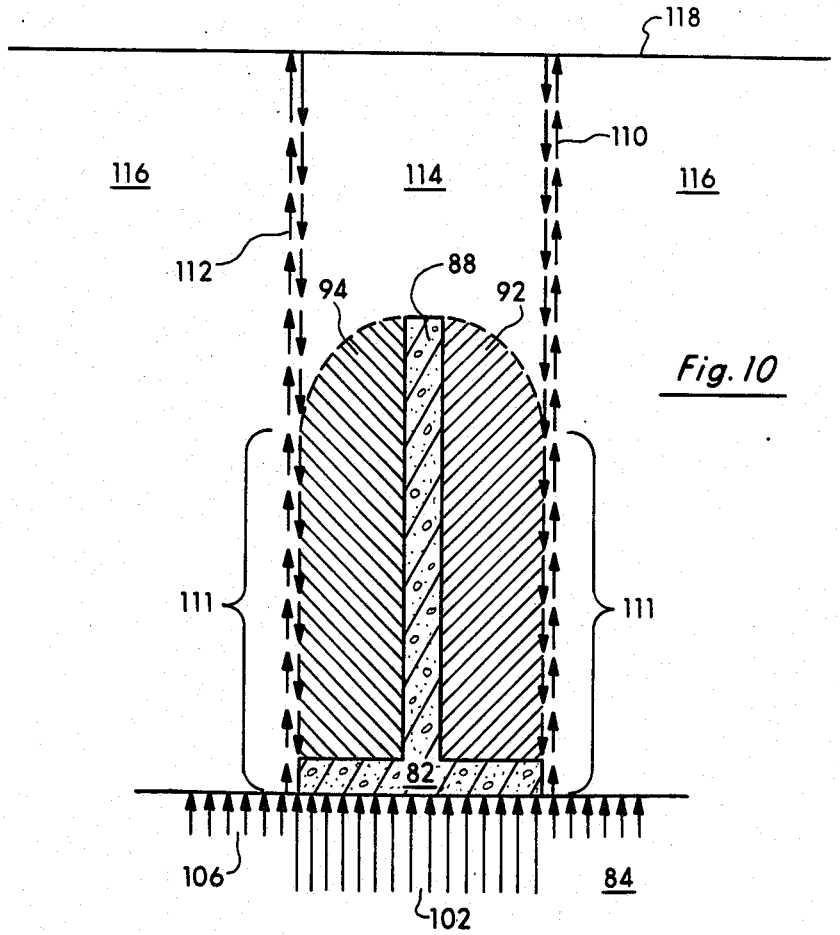
FIG. 10 is a cross-sectional view of the base portion of the tieback element illustrated in FIG. 9 showing forces acting on the base element and shear planes produced in response to movement of the tieback element.

FIGS. 9 and 10 schematically illustrate the manner in which active arching theory and Marston's Theory of loads on underground conduits is utilized and analyzed in the retaining wall system of the present invention. As illustrated in FIG. 10, the base portion 82 of the tieback element has, as its foundation, backfill material 84 which meets suitable design criteria and which comprises any suitable soil for use with the present invention. As defined herein, soil can comprise gravel, sand, loam, silt/clay materials or any type of backfill material which is classified as either A-1, A-2, A-3 or A-4 according to the American Association of State Highway and Transportation Officials (AASTO Soil Classification System). The concrete tieback element 86, as illustrated in FIG. 9, has a base portion 82 and a column portion 88 which comprise the tieback base 90 which projects back into the soil. The web portion 88 projects in an upward direction into the overlying backfill in a manner similar to a conduit. Because of the large shear stresses developed between the web portion 88 and the backfill material, the backfill 92, 94 in the shaded portions moves as an integral part of the tieback base 90. In this manner, the tieback base 90 and soil 92, 94, as illustrated in FIG. 10, represent an effective conduit such as that analyzed by Marston and disclosed in Spangler and Handy, supra.

FIG. 9 illustrates a force block diagram 96 of forces acting upon column portion 98 of the tieback element 86. The force block diagram 96 is a result of forces acting on the column portion 98 from backfill behind the wall panels which contact column portion 98 of the tieback element 86. The forces on these wall panels are transferred into the tieback element 86 to produce the force block diagram 96. As illustrated in FIG. 9, a gradient of forces is produced such that higher forces are produced at lower portions along the column portion 98. These forces can be summed and averaged to produce a resultant force acting against the column portion 98 at a distance between one-half and one-third of the distance from the bottom of the column portion 98. The resultant horizontal force produces an overturning moment 97 which tends to rotate tieback element 86 in the direction indicated.

The moment force 97 causes increased bearing stresses 102 on the base 82 of tieback base 90. This is especially true at the toe portion 104 of the tieback base 90. The bearing stresses 106 on soil horizontally aligned with the bottom of base 102 are substantially smaller than the bearing stresses 102 underneath the tieback base 82, as illustrated in FIG. 10. If the stresses 102 are greater than the bearing stresses of the soil, the tieback element 86 will rotate in a downward direction at toe portion 104 as result of moment 96. The amount the toe portion 104 moves is indicated by "d". As shown in FIG. 9, the tieback base 90 moves downward relatively to adjacent backfill materials which causes a ditch condition to develop in which the shear stresses act upwardly. At the toe 104 of tieback base 90, the applied stress due to weight of backfill is decreased by the arching produced in the soil.

As a result of movement of the tieback element 86 in the direction illustrated by moment 96, shear planes 110, 112 are developed in the backfill of the tieback base 90 to separate the backfill in two blocks of soil, i.e., a first block of soil 114 between shear stresses 110, 112, and the second block of soil 116 which are outside of shear stresses 110 and 112. An important consideration in the application of Marston's Theory is the determination of whether the differential movement between the first block of soil 114 and the second block of soil 116 is sufficient to cause shear planes to be developed to the surface of the backfill 118. If the shear planes 110, 112, as illustrated in FIG. 10, extend all the way to the ground surface 118, this condition is known as a complete ditch condition. If the shear planes 110, 112 do not exist all the way to the surface, an incomplete ditch condition exists. During experimentation performed at the Geotechnical Engineering Laboratory of Colorado State University, as set forth below, it was determined that the web portion 88 influences the amount of arching and determines the size of the effective conduit for analysis. If it is sufficiently high, the load on the tieback base 90 is independent of the settlement ratio between the first block of soil 114 and the second block of soil 116.

Depending upon whether the relative movement of the tieback base 90 is upward or downward relative to the backfill material, shear stresses in the backfill may be generated either upwardly or downwardly and may either decrease or increase the load on the tieback base 90. The ditch condition occurs when the shear stresses decrease the load on the tieback base 90. If shear stresses increase the load on the tieback base 90, the projection condition exists. The ditch condition represents a case of active arching. The projection condition represents passive arching.

Since the tieback element 86 moves in a downward direction as a result of moment 97, the ditch condition occurs and shear stresses act upwardly. Consequently, the shear stresses on soil below toe 104 due to the weight of the backfill forces 96 transferred from the wall panels to tieback element 86 are decreased by arching.

The height of the web portion 88 must also be sufficiently large to engage the first block of soil 114 to transfer the shear stresses from shear planes 110, 112 to the web portion 88. The arching produced by the shear stresses therefore supports the tieback element by way of the web portion 88 so that bearing stresses are greatly reduced upon rotational movement of the tieback element 86.

The web portion 88 must be sufficiently large to integrally engage a sufficient amount of soil 94 around the tieback base 90 to produce shears 111 between the soil 94 engaged by the web portion 88 and the second block of soil 116 having a length sufficient to support the tieback element 86 at load values which exceed the bearing capacity of the soil below the tieback element 86 and transfer these loads into the adjacent blocks of soil 116. Hence, the forces transferred into the tieback elements 86 from the wall panels are not transferred to the bearing support soil, but rather, are transferred into the adjacent blocks of soil 116 as a result of shears 111. It is apparent, therefore, that the longer the shears 111 are, the greater the transfer of loads into the adjacent blocks of soil 116 and the greater the reduction of forces on the bearing soil. This means that the height of the web portion greatly affects the magnitude of the forces which the tieback element can support. Another way of considering the effect of the web portion is that as the web portion gets higher, the more it locks the tieback element into the first block of soil 114. The more the tieback element 86 is locked into the first block of soil, the greater the support tieback element 86 can provide in response to forces transmitted to tieback element 86 from the wall panels. Consequently, the loads can be reduced to zero in certain circumstances and even resist a downward pull out force after a foundation failure. Although the actual shears produced may vary in position, direction and number from that illustrated in FIG. 10, the shears produced have vertical components which function to support the tieback element 86.

If sufficient rotation is imparted in tieback element 86, the heel 118 of tieback base 90 may tend to move in an upward direction, thereby creating a projection condition and increasing the vertical load applied to the heel 118 of tieback base 90. The reduction in bearing stresses under toe 104 and the increase in the vertical load applied to heel 118 in tieback base 90 enhance the stability of the tieback unit 86. Depending upon the amount of rotation which occurs and the arching which is transferred to the tieback unit, bearing stresses on base 82 can be multiplicatively decreased. In order to investigate the phenomenon of arching over tieback footings and the appropriate parameters to use in applying Marston's Theory, a series of experiments were conducted at the Colorado State University Geotechnical Engineering Laboratory. The results of these experiments are presented below.

Experimental Results

An experiment was performed similar to Terzaghi's well-known trap door experiment described in *Theoretical Soil Mechanics*, supra. An 8' by 4.5' by 4' box with an open top and a slot in the floor was constructed of 0.75" thick plywood. The box was reinforced with dimension lumber along the inside perimeter and at the third point in the form of wales on the outside. The front end of the box was constructed to be removable for ease of placement and removal of backfill. A one-third scale model of a footing with three different stem walls of different shapes were cast of reinforced concrete. Slotted brackets made of channel iron were cast in the surface of the footing. Small pipe sections were cast through the thickness of the wall sections along the bottom edges to facilitate connection of the footing with various stem shapes. Since the wall section must necessarily be moved up and down in the box, the slot in the box was made slightly larger than the outside dimension of the footing. To prevent sand backfill from running out of the box, soft foam rubber strips were placed along the edges and the ends of the wall assembly. The frictional resistance of the foam against the stem wall was measured and observed to be small compared to the magnitude of the forces imparted by the backfill.

The soil used in the study was a clean air dried subangular concrete sand. This sand had 2.8% passing the #2 sieve, and 100% passing the #4 sieve. The soil was classified as a poorly graded sand (SP) according to the Unified Soil Classification System. Engineering properties of the sand are shown in Table 1.

TABLE 1

ENGINEERING PROPERTIES OF SAND USED IN EXPERIMENTS

| | |
|---|---|
| Void Ratio | minimum 0.43<br>maximum 0.63 |
| Dry Unit Weight | minimum 101.5 pcf<br>maximum 115.8 pcf |
| Angle of Internal Friction | loose 37 degrees<br>dense 52 degrees |

During the preparation phase of each experiment, the wall section was supported and leveled atop a pair of mechanical scissor jacks. The foam rubber was placed around the edges of the footing in the wall section. The instrumentation consisted of load cells mounted on two hydraulic jacks and two linear variable differential transformers positioned beneath the wall near each end. A strain indicator with a switch box was used to monitor the output of the load cells and a digital volt meter was used to monitor the output voltage from the two linear variable differential transformers.

The box was then filled in lifts of 12 to 16 inches depending on the final height of fill in each experiment. A concrete vibrator was used to densify the sand.

All experiments were begun with an active sequence, in which one or both jacks positioned at the front and back end of the stem wall were lowered in 0.05 to 0.10 inch increments. The loads were monitored with time during each increment until equilibrium was achieved. The sequence was continued until, in most cases, the load cell outputs were near zero, and the wall section was completely supported by the backfill. In some experiments, a passive sequence was used in which the wall was moved upwards, followed by the active sequence. In other cases, the backfill was vibrated in place, and a second active sequence was performed.

Figure 11:
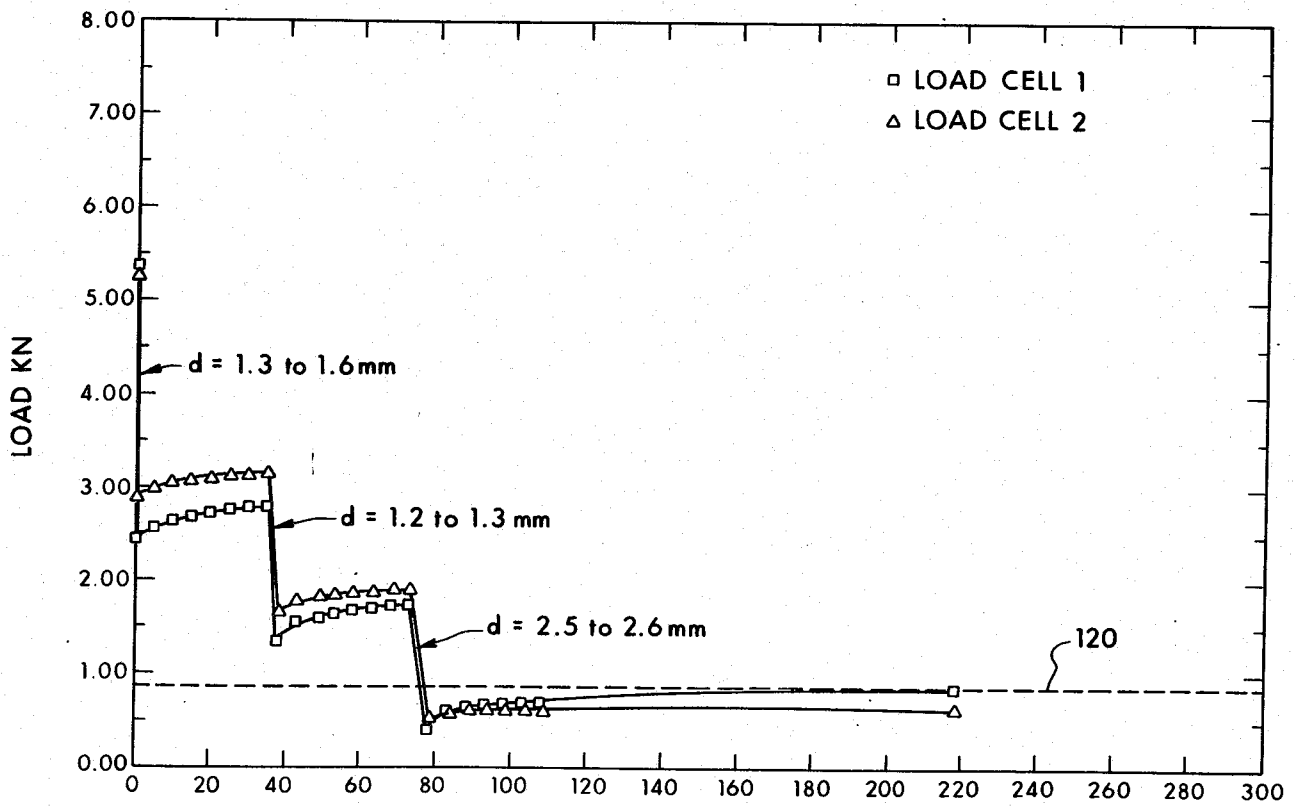
FIG. 11 is a graph of experimental data illustrating the load on a stem wall versus time for several sequential displacements of supporting jacks.

FIG. 11 is a graph illustrating lapse time in minutes versus load on the jacks as the wall was moved downward in three increments. Initially after each movement, the load decreased by a large magnitude, and then increased slightly before reaching an equilibrium value. This corresponds to the active arching or ditch condition, in which a portion of the vertical load acting on a buried structure is transferred to adjacent sidefills. The opposite effect occurred when the wall was moved in an upward direction. The loads increased by an initial magnitude and then decreased slightly before attaining equilibrium.

Figure 12:
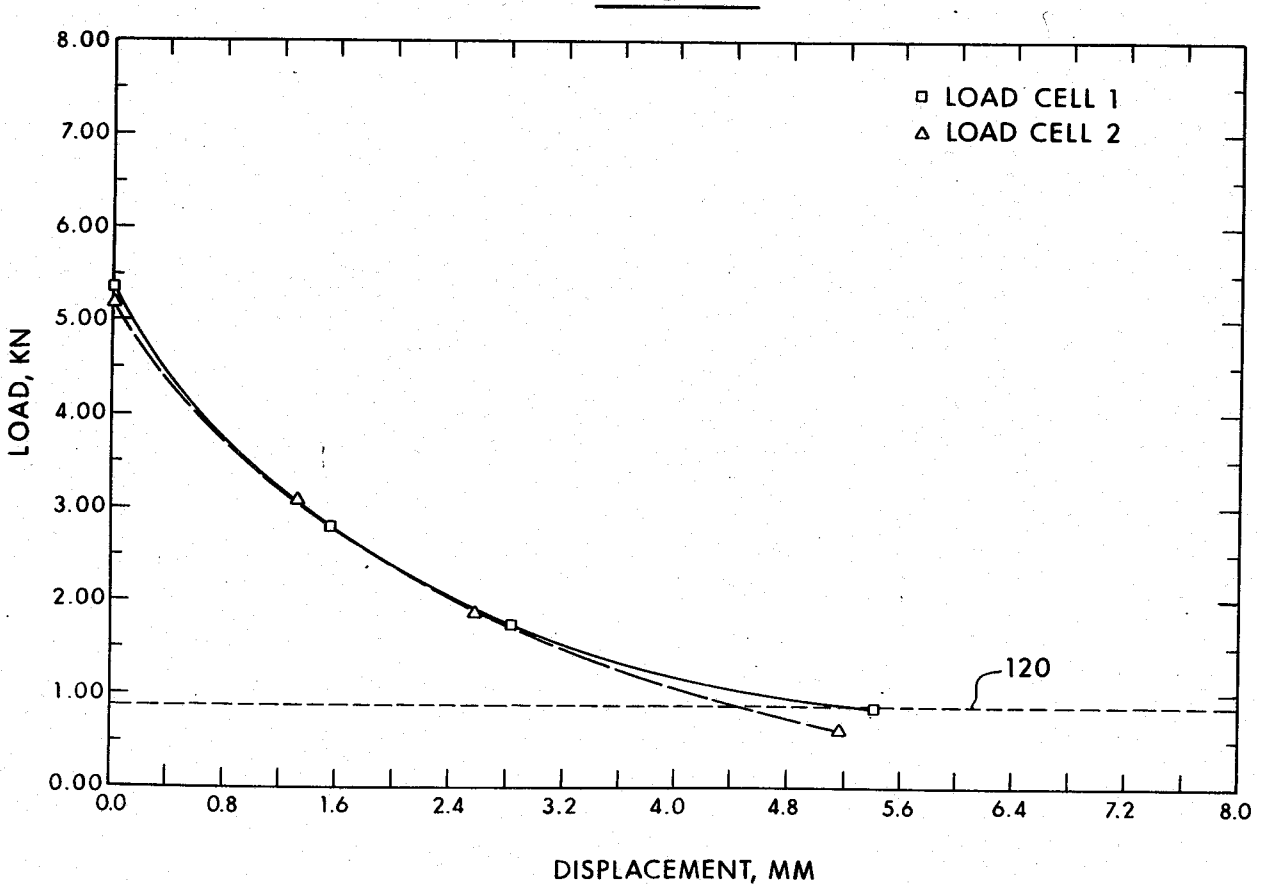
FIG. 12 is a graph of experimental data illustrating load on a stem wall versus displacement.

FIG. 12 is a graph illustrating displacement in millimeters versus load in kiloneutons. FIG. 12 is a typical plot of equilibrium load versus vertical displacement for the active condition. The dotted line in both FIGS. 11 and 12 represents the static loads supported by each hydraulic jack, without backfill in the box, i.e., the weight of the stem wall. In all experiments with compacted backfill, the load was reduced to a value at or below the static value with less than 0.2 inches of downward movement of the wall section. ith large movements, the load decreased to a value less than the weight of the footing, indicating that friction between the stemwall and backwall was sufficient to completely support the stem wall.

After equilibrium load on the jacks was reached at each increment of movement, the loads remained quite stable. This indicates that the arching phenomenon is not a transient occurrence and the reduction in the load is maintained for long periods of time. This has been confirmed in field measurements by other investigators as well, including Spangler and Handy, supra, FIG. 26.14.

Upon relating these results to Marston's Theory, it is clear that a complete ditch condition is generated upon movement of the tieback elements. This is a result of the use of tieback base 90 which is sufficiently large to produce the complete ditch condition with very small movements, i.e., on the order of ½ inch for full scale tieback elements as indicated by the experimentation. Arching produced by shear stresses is generated from shear planes 110, 112 causing reduced bearing stresses 102 on tieback base 90. The arching is produced as a result of web portions 88 which are sufficiently large to cause integral movement of a sufficient amount of soil adjacent the web portion 88 to generate shear planes 110, 112.

Consequently, the results of the experiments clearly indicate that active arching sufficient to multiplicatively reduce the bearing stresses on the tieback elements can be produced with a very small displacement of the tieback element. Consequently, a multitiered wall can be produced with a very small separation between vertical tiers which is sufficient to allow independent analysis of each tier. This is a result of the fact that a complete ditch condition can be generated with very small movement of the tieback element. Active arching produced as a result of independent movement of each of the tiers greatly reduces the bearing stresses on each independent tier so that multiple tier walls can be produced without the necessity for using extended tieback bases. This results in a system which is economically feasible to produce and install and is useful in many applications where the cut into the embankment must be limited.

Implementation and Alternative Embodiments

Figure 16:
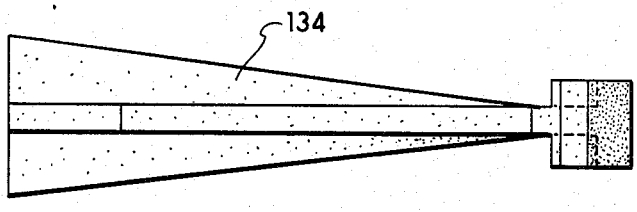
FIG. 16 is an alternative design of the tieback element as illustrated in FIGS. 13–15.
Figure 13:
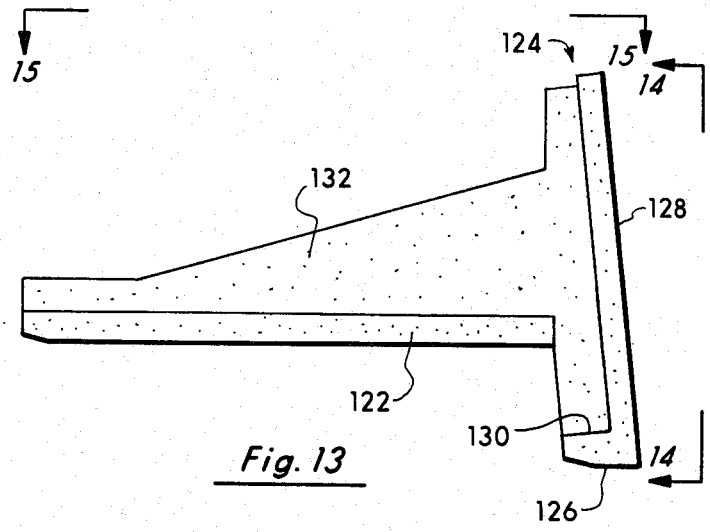
FIG. 13 is a schematic side view of an alternative embodiment of a tieback element of the present invention.

FIG. 13 is a side view of an alternative embodiment of a tieback element which can be utilized in accordance with the present invention. As illustrated in FIG. 13, base portion 122 is coupled to column portion 124 at a point which is approximately one-third of the distance from the bottom of toe portion 126. The front face 128 of column portion 124 is battered. Toe portion 126 extends laterally to provide support for a wall panel disposed to rest on surface 130. Web portion 132 is sufficiently large to integrally engage the first block of soil to reduce bearing stresses on base portion 122 and toe 126. The bottom of base portion 122 is disposed at a point which is about one-third of the distance from the bottom of the column portion 124 to reduce bearing stresses on base portion 122 resulting from the overturning moment 96 (FIG. 9). As set forth in FIG. 9, the resultant force is at a point which is approximately one-third of the distance from the bottom of the column portion 98. By placing the base 122 at the one-third point, bearing stresses are reduced. However, pullout resistance is decreased because of the reduced surface area of the web. Consequently, the design of the base portion, such as shown in FIG. 16, is a wedge configuration, which increases the resistance of the tieback element to the pullout forces. The wedge shaped base portion 134 of FIG. 16 has increased pullout resistance to overcome the increased pullout forces generated as a result of placing the base portion at a distance one-third of the distance from the bottom of the column portion.

Figure 14:
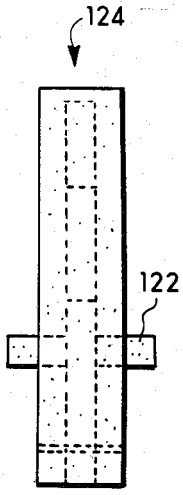
FIG. 14 is a front view of the tieback element illustrated in FIG. 13.

FIG. 14 is a front view illustrating the manner in which base portion 122 is placed at approximately one-third of the distance from the top of column portion 124.

Figure 15:
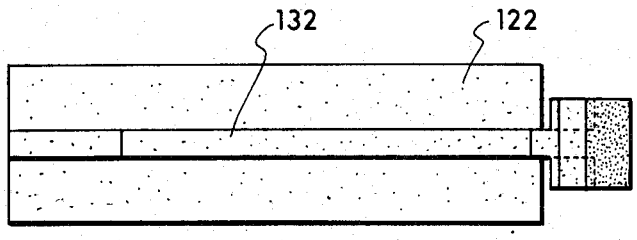
FIG. 15 is a top view of the tieback element illustrated in FIGS. 13 and 14.

FIG. 15 is a top view of the embodiments illustrated in FIGS. 13 and 14 showing the configuration of the base portion 122 and web portion 132.

Figure 17:
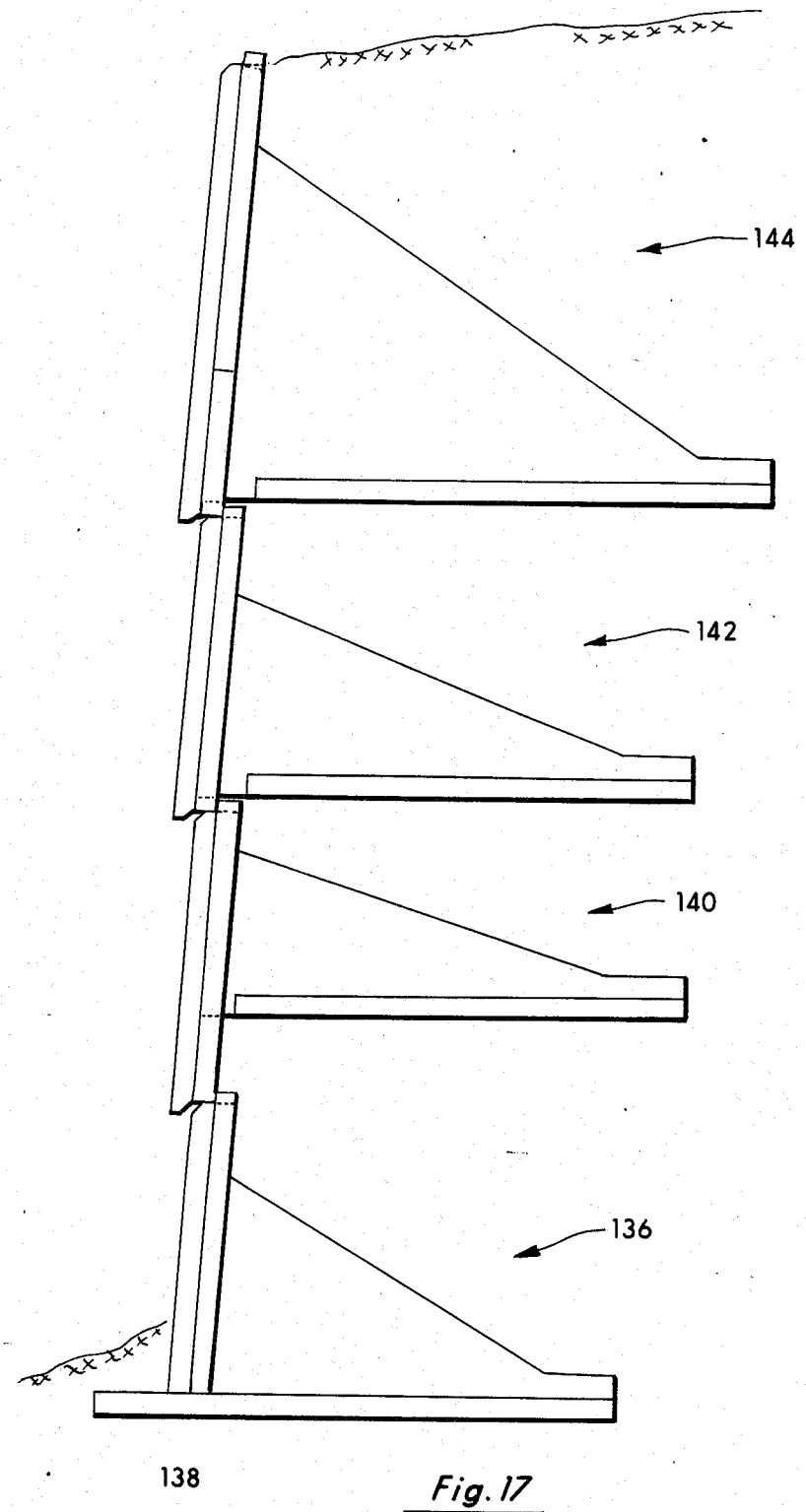
FIG. 17 is a schematic side view of one implementation of various types of tieback elements which can be employed in a multiple tier wall of the present invention.

FIG. 17 is a schematic side view of an alternative implementation of various tieback elements of the present invention. Base tier 136 has a footing portion 138 which extends beyond the column portion to decrease bearing stresses. Second tier 140 comprises a tieback element having the base portion 142 disposed one-third of the distance from the bottom of the column portion to reduce bearing stresses. Since bearing stresses are generally quite high on the second tier, it is useful to utilize tieback element 140 on the second tier. Tieback element 142 is a standard intermediate tier tieback element which is typically 8 feet in height. Tieback element 144 can comprise a 12 foot high tieback element since bearing stresses on tieback element 144 are less than that for lower tiers due to a lack of a surcharge from backfill of upper tiers.

Figure 18:
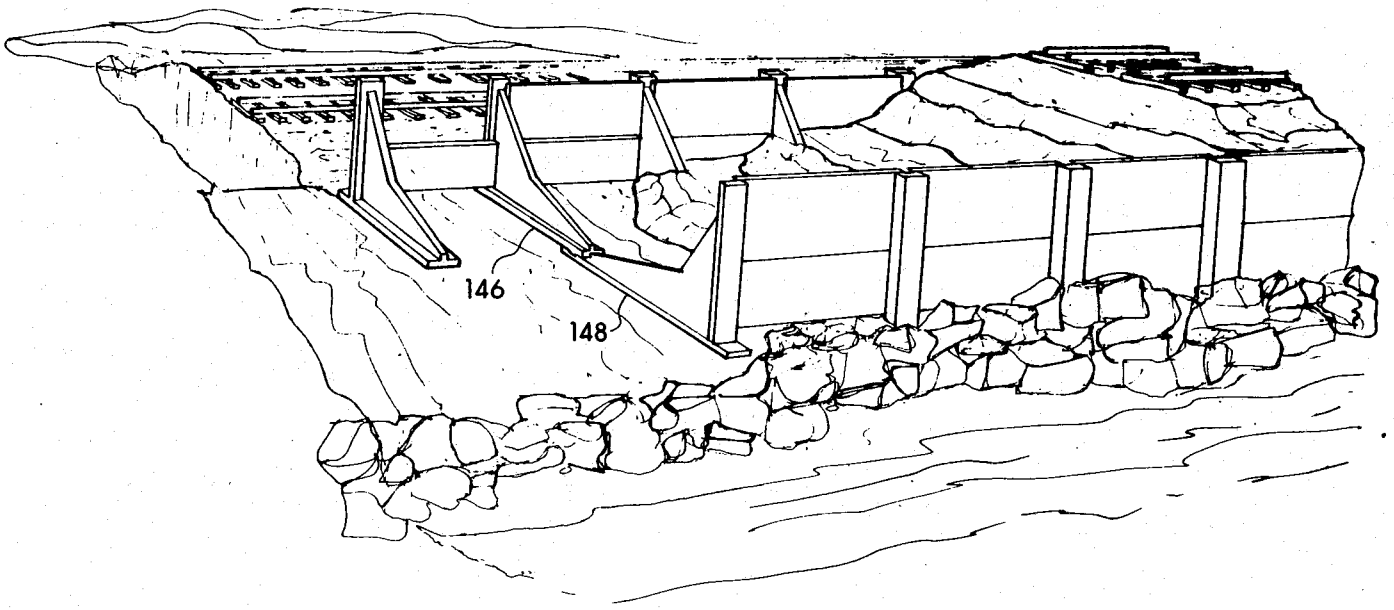
FIG. 18 is a schematic isometric view of the present invention employed as a single tiered wall on a raised causeway.

FIG. 18 is a schematic illustration of a single tier wall in which the tieback bases 146, 148 for opposing tieback units are coupled together to resist overturning moments. The tieback bases can be coupled together in any desired manner including forming of the end portions of the tieback bases in any desired coupling arrangement. FIG. 18 illustrates the manner in which a single tiered unit can be used to build a causeway for railroad tracks on an adjoining service road. As illustrated in FIG. 18, a retaining wall system can then be built over the existing tracks for use as a service road.

Figure 19:
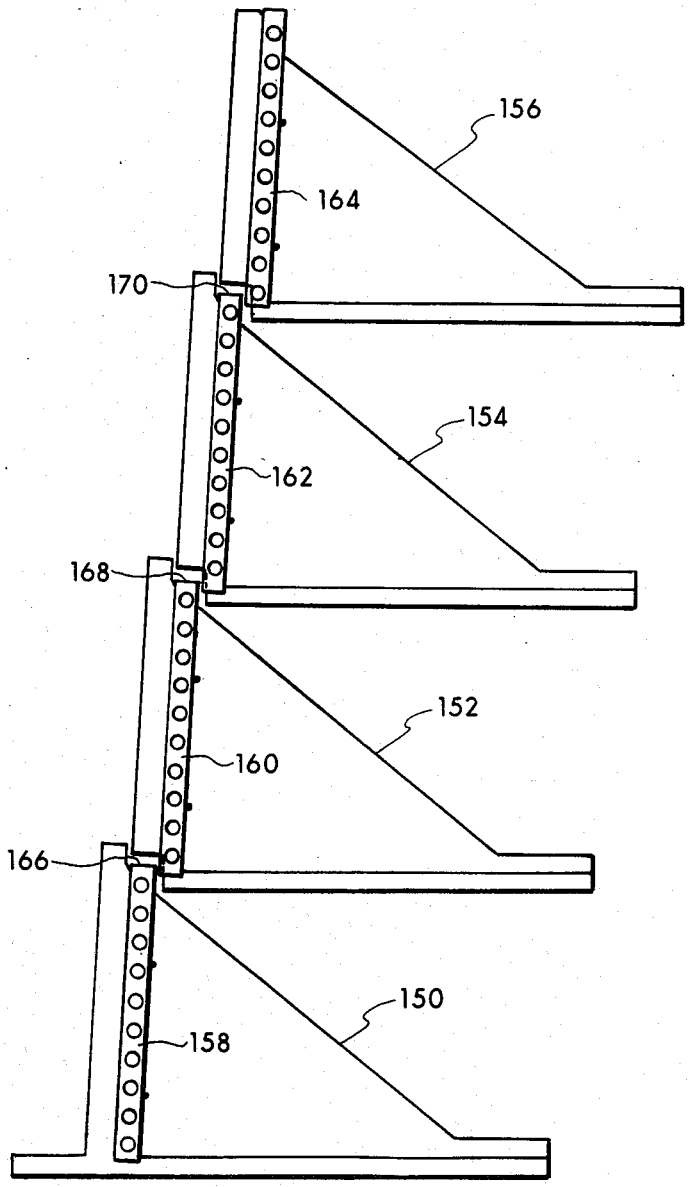
FIG. 19 is a schematic side view of the present invention employed as a battered wall.

FIG. 19 is a schematic sideview of an alternative embodiment of the present invention. As illustrated in FIG. 19, each of the tieback elements 150, 152, 154, 156 is sequentially set back to produce a battered wall. The wall panels 158, 160, 162, 164 are supported by the tieback elements of each tier, respectively. Gaps 166, 168, 170 between each of the vertical tiers provide a sufficient amount of vertical clearance to allow each of the tiers to move sufficiently to produce a complete ditch condition. The wall panels overlap by an amount to ensure that vertical gaps do not appear in the wall face. The embodiment illustrated in FIG. 19 is particularly useful for battered walls and any implementation where an absolutely vertical wall is not required.

Consequently, the present invention provides a retaining wall system which utilizes tieback elements sufficiently large to generate a complete ditch condition with relatively minor downward movement of the tieback elements so that bearing stresses are reduced on base portions of the tieback elements. This results in an economically usable system with tieback bases having a length which is economically feasible to fabricate and install. Additionally, it has been determined that the amount of movement required to produce a ditch condition is sufficiently small to allow multiple tiers to be constructed with relatively small spacing between the tiers to generate a complete ditch condition and allow the tiers to move independently and produce a relatively small displacement to produce shear stresses and arching sufficient to greatly reduce bearing stresses. This overcomes the disadvantages and limitations of prior art static leverage walls which require tieback bases typically three times as long as the height of the tier. Consequently, the present invention provides a retaining wall system which is highly economical to both fabricate and install.

We claim:

1. A method of retaining soil using a multitiered, substantially vertical retaining wall system having a plurality of individual tiers which are substantially vertically aligned, each of said individual tiers having a plurality of rigid tieback elements which support a plurality of wall panels that engage said soil, said rigid tieback elements having base portions, column portions and web portions that couple said base portions and said column portions comprising the steps of:

forming each individual tier of said plurality of individual tiers as follows:

placing said rigid tieback elements of each individual tier on a substantially horizontal plane with said base portions disposed substantially horizontally;

placing wall panels between said tieback elements such that said wall panels engage said column portions;

backfilling said soil against said wall panels and over said base portions to form said substantially horizontal plane for an adjacent higher tier such that said base portions engage said soil;

stacking said individual tiers to form said multitiered, substantially vertical retaining wall as follows:

placing each individual tier of said plurality of individual tiers so that said substantially vertical retaining wall system is formed;

providing a predetermined vertical gap between each individual tier of said plurality of individual tiers by forming said substantially horizontal plane so that said rigid tieback elements and said wall panels are vertically spaced from adjacent vertically disposed tiers by said predetermined vertical gap, said predetermined vertical gap having a spacing sufficient for soil conditions to allow each individual tier of said plurality of individual tiers to move in a vertical direction independently of said adjacent vertically disposed tiers in response to forces generated by said soil such that shears are produced in said soil which cause arching in said soil around said base portions of said rigid tieback elements that supports said base portions and which resists additional vertical movement of said plurality of individual tiers so as to provide stability to said multitiered, substantially vertical retaining wall system.

2. The method of claim 1 further comprising the steps of:

battering said column portion of said tieback elements such that said substantially flat wall panels have a battered orientation;

overlapping each successively higher vertical tier by an amount sufficient to produce a substantially vertical wall.

3. The method of claim 2 further comprising the steps of:

increasing slope stability and reducing bearing stresses on said tieback elements on a bottom tier by providing a footer portion which extends substantially horizontally from said column portion in a direction substantially opposite to said base portion.

4. The method of claim 1 further comprising the steps of:

coupling said base portions to said column portions of said tiebacks at a point which is approximately one-third of the distance from the bottom of column portions to reduce overturning moment forces produced by horizontal forces from backfill so as to reduce bearing stresses on soil supporting said tieback elements.

5. The method of claim 4 further comprising the steps of:

increasing pullout resistance of said tieback elements by shaping said base portions in a wedge configuration.

6. The method of claim 4 further comprising the steps of:

supporting said wall panels with a support element disposed on said column portions.

7. A single tier retaining wall system for retaining soil comprising:

wall panel means for retaining said soil such that said soil produces a resultant force which acts on said wall panel means at a predetermined location;

column member means for engaging said wall panel means and supporting said wall panel means in a substantially vertical orientation such that said resultant force acting against said wall panel means is transferred to said column member means, and said resultant force acts against said column member means at a predetermined location on said column member means;

base member means connected to said column member means at approximately said predetermined location on said column member means such that a portion of said column means extends below said base member means and a longer portion of said column member means extends above said base member means such that said resultant force on said column member means is substantially aligned with said base member means causing an equilibrium moment condition wherein moment arms of said resultant horizontal force acting on said column member means are substantially eliminated.

8. The retaining wall system of claim 7 further comprising:

support means connected to said column member for supporting said wall panel means.

9. The retaining wall system of claim 7 wherein said base member means has a wedge configuration to resist increased pullout forces produced on said base member means as a result of reducing said moment arm of said resultant horizontal force generated by said soil retained by said wall panel means.

10. A substantially vertical, multitiered retaining wall system for retaining soil comprising:

a plurality of vertically positioned tiers which are substantially vertically aligned with each individual tier of said plurality of vertically positioned tiers which are stacked in a substantially vertical orientation to form said substantially vertical, multitiered retaining wall system, each individual tier of said plurality of individual tiers comprising:

wall panel means for retaining said soil;

tieback means aligned to engage said wall panel means said tieback means comprising:

column member means for engaging and supporting said wall panel means;

base member means rigidly coupled to said column member means and disposed in said soil substantially horizontally a predetermined distance;

predetermined vertical gap means provided between each individual tier of said plurality of vertically positioned tiers for providing sufficient vertical spacing between said plurality of vertically positioned tiers for site specific soil conditions to allow each individual tier to move in a vertical direction independently of adjacent vertically positioned tiers in response to forces generated by said soil by an amount sufficient to ensure that shears are produced in said soil upon independent vertical movement of each individual tier, said shears causing soil arching around said base member means that supports said base member means and resists additional vertical movement of said base member means so as to provide stability to said multitiered, substantially vertical retaining wall system.

11. The retaining wall system of claim 10 wherein said tieback means are substantially vertically aligned with one another in said substantially vertically aligned tiers to concentrate said soil arching in said first block of said soil and reduce bearing pressures on said tieback means.

12. The retaining wall system of claim 10 further comprising:

notch means formed in said base member means to allow said tieback means to be overlapped for each successively higher tier by an amount sufficient to provide a substantially vertical wall and provide sufficient vertical clearance to allow independent relative movement between adjacent vertical tiers by an amount sufficient to cause said soil arching and stabilize said tieback means.

13. The retaining wall system of claim 10 wherein said base member means extend in a lengthwise direction beyond said column member means to form footer means which decreases bearing pressures on said base member means by distributing said bearing pressures in said lengthwise direction beyond said column member means.

14. The retaining wall system of claim 10 wherein said column member means overlap column member means of an adjacent lower tier and are battered by an amount sufficient to provide said substantially vertical retaining wall system.

15. The retaining wall system of claim 10 wherein at least one tier of said tieback means has base member means attached to said column member means at a point which is approximately one-third of the distance from the bottom of said column member means to reduce overturning moment forces on said tieback means.

16. The retaining wall system of claim 15 wherein said base member means are wedge shaped to resist pullout forces produced on said tieback means.

* * * * *